US012405083B1

(12) United States Patent
Walters

(10) Patent No.: US 12,405,083 B1
(45) Date of Patent: Sep. 2, 2025

(54) HOLSTER-MOUNTING SYSTEM

(71) Applicant: Edward Walters, Joppa, MD (US)

(72) Inventor: Edward Walters, Joppa, MD (US)

( * ) Notice: Subject to any disclaimer, the term of this patent is extended or adjusted under 35 U.S.C. 154(b) by 267 days.

(21) Appl. No.: 18/144,920

(22) Filed: May 9, 2023

(51) Int. Cl.
*F41C 33/04* (2006.01)

(52) U.S. Cl.
CPC ..... *F41C 33/041* (2013.01)

(58) Field of Classification Search
CPC ..... F41C 33/041; F41C 33/04; F41C 33/045; F41C 33/008; F41C 33/02; B60R 7/14; B60R 11/00; B60R 11/06
USPC ..... 248/206.5; 211/64; 224/562
See application file for complete search history.

(56) References Cited

U.S. PATENT DOCUMENTS

| | | | | |
|---|---|---|---|---|
| 5,957,308 | A * | 9/1999 | Zierenberg | A47B 81/005 211/119.004 |
| 7,380,692 | B2 | 6/2008 | Kostal | |
| 9,227,573 | B2 | 1/2016 | Hudspeth | |
| 9,340,164 | B2 * | 5/2016 | Pickett | B60R 7/14 |
| 10,101,119 | B2 * | 10/2018 | Tedder | F41C 33/02 |
| 10,145,650 | B1 | 12/2018 | Terhark | |
| 10,393,479 | B1 | 8/2019 | Bradford | |
| D887,706 | S | 6/2020 | Evans | |
| 10,808,883 | B2 * | 10/2020 | Stechmann | H02G 3/30 |
| 2017/0160050 | A1 * | 6/2017 | Alfaro | F41C 33/008 |

FOREIGN PATENT DOCUMENTS

| | | |
|---|---|---|
| WO | 2006055053 | 5/2006 |

* cited by examiner

*Primary Examiner* — Corey N Skurdal
(74) *Attorney, Agent, or Firm* — Kyle A. Fletcher, Esq.

(57) ABSTRACT

The holster mounting system is a load bearing structure. The holster mounting system includes a plurality of mounting structures, a plurality of securing structures, and a holster structure. The holster mounting system attaches the holster structure to a mounting surface. Any securing structure selected from the plurality of securing structures secures the holster structure to the plurality of mounting structures. Any securing structure selected from the plurality of securing structures transfers the load of the holster structure to the plurality of mounting structures. The plurality of mounting structures secures any securing structure selected from the plurality of securing structures to the mounting surface.

11 Claims, 5 Drawing Sheets

HOLSTER-MOUNTING SYSTEM

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of special attachments for connecting a holster to an object. (F41C33/041)

SUMMARY OF INVENTION

The holster-mounting system is a load bearing structure. The holster-mounting system comprises a plurality of mounting structures, a plurality of securing structures, and a holster structure. The holster-mounting system attaches the holster structure to a mounting surface. Any securing structure selected from the plurality of securing structures secures the holster structure to the plurality of mounting structures. Any securing structure selected from the plurality of securing structures transfers the load of the holster structure to the plurality of mounting structures. The plurality of mounting structures secures any securing structure selected from the plurality of securing structures to the mounting surface.

These together with additional objects, features and advantages of the holster-mounting system will be readily apparent to those of ordinary skill in the art upon reading the following detailed description of the presently preferred, but nonetheless illustrative, embodiments when taken in conjunction with the accompanying drawings.

In this respect, before explaining the current embodiments of the holster-mounting system in detail, it is to be understood that the holster-mounting system is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the holster-mounting system.

It is therefore important that the claims be regarded as including such equivalent construction insofar as they do not depart from the spirit and scope of the holster-mounting system. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
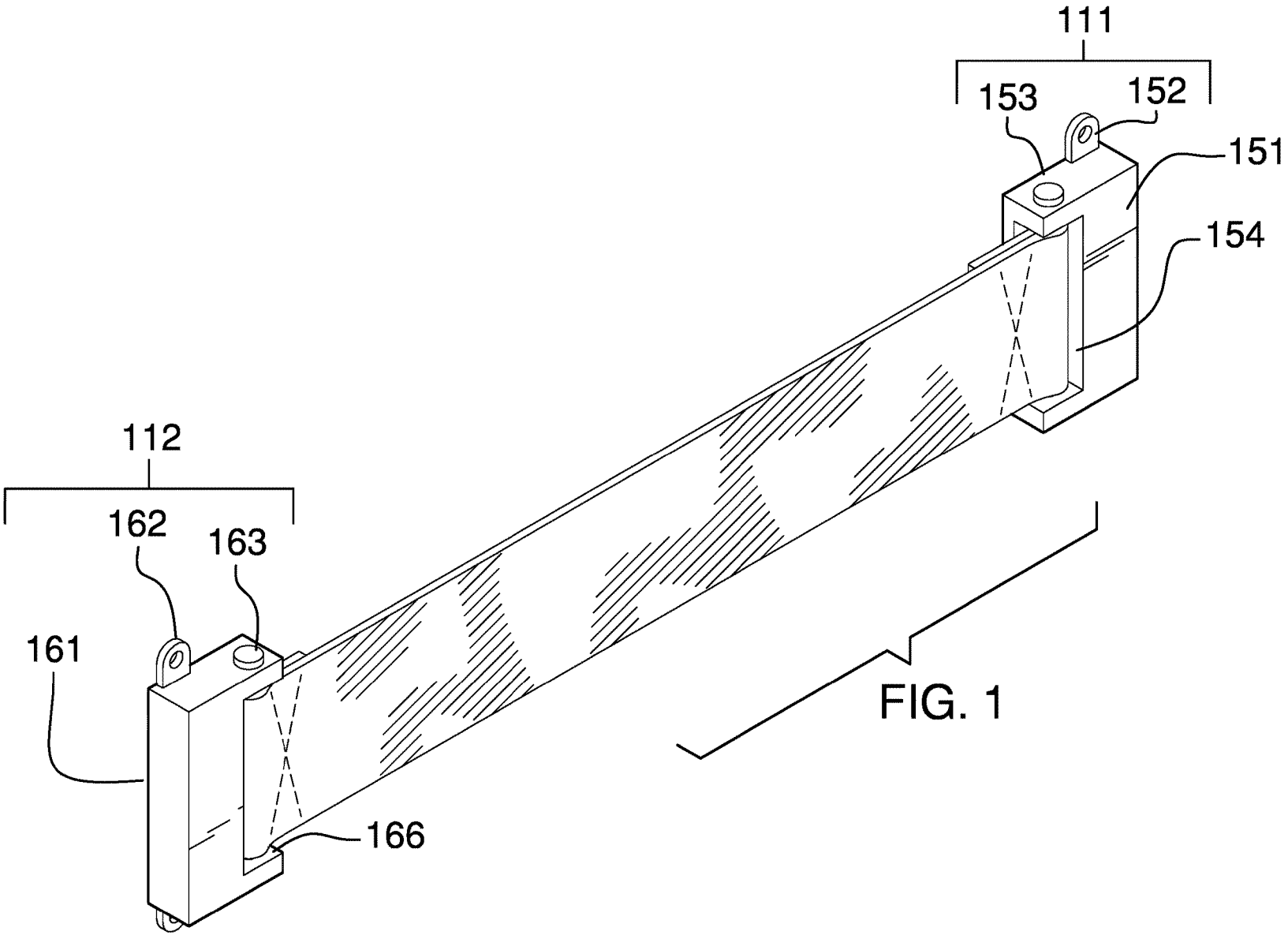
FIG. 1 is a perspective view of an embodiment of the disclosure.
Figure 2:
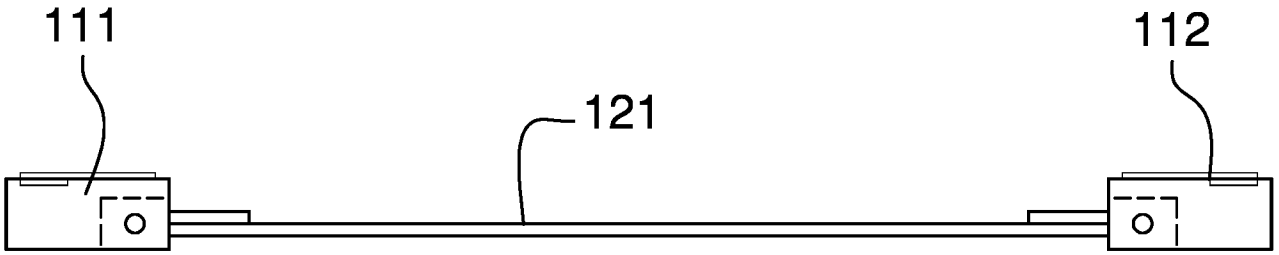
FIG. 2 is a top view of an embodiment of the disclosure.
Figure 3:
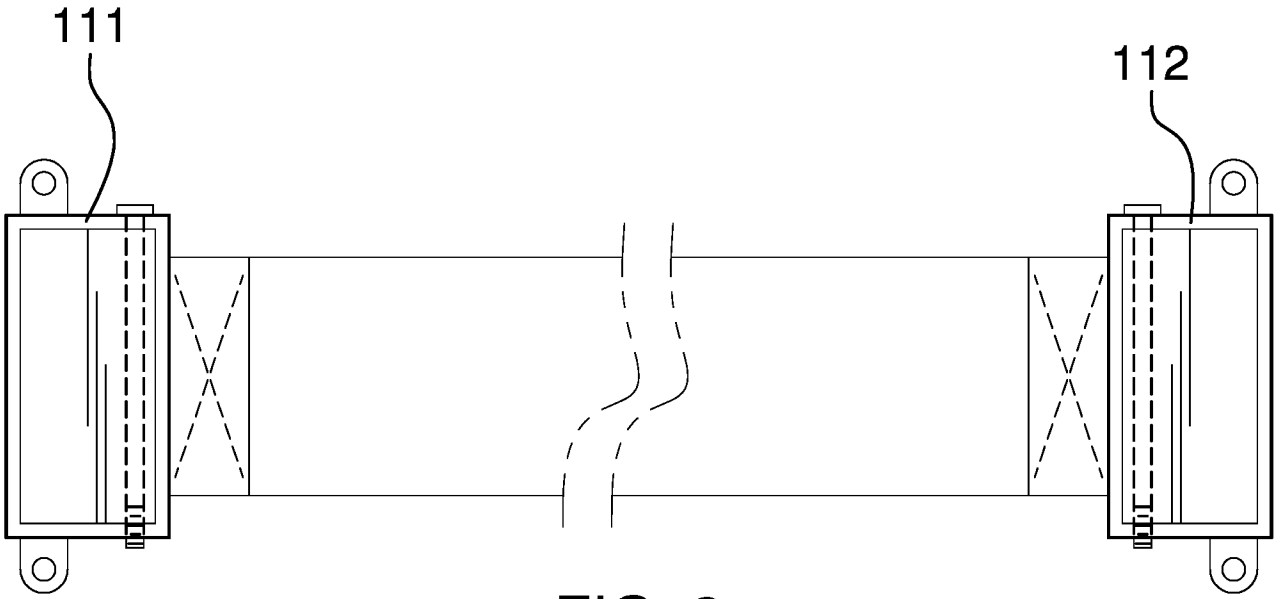
FIG. 3 is a rear view of an embodiment of the disclosure.
Figure 4:
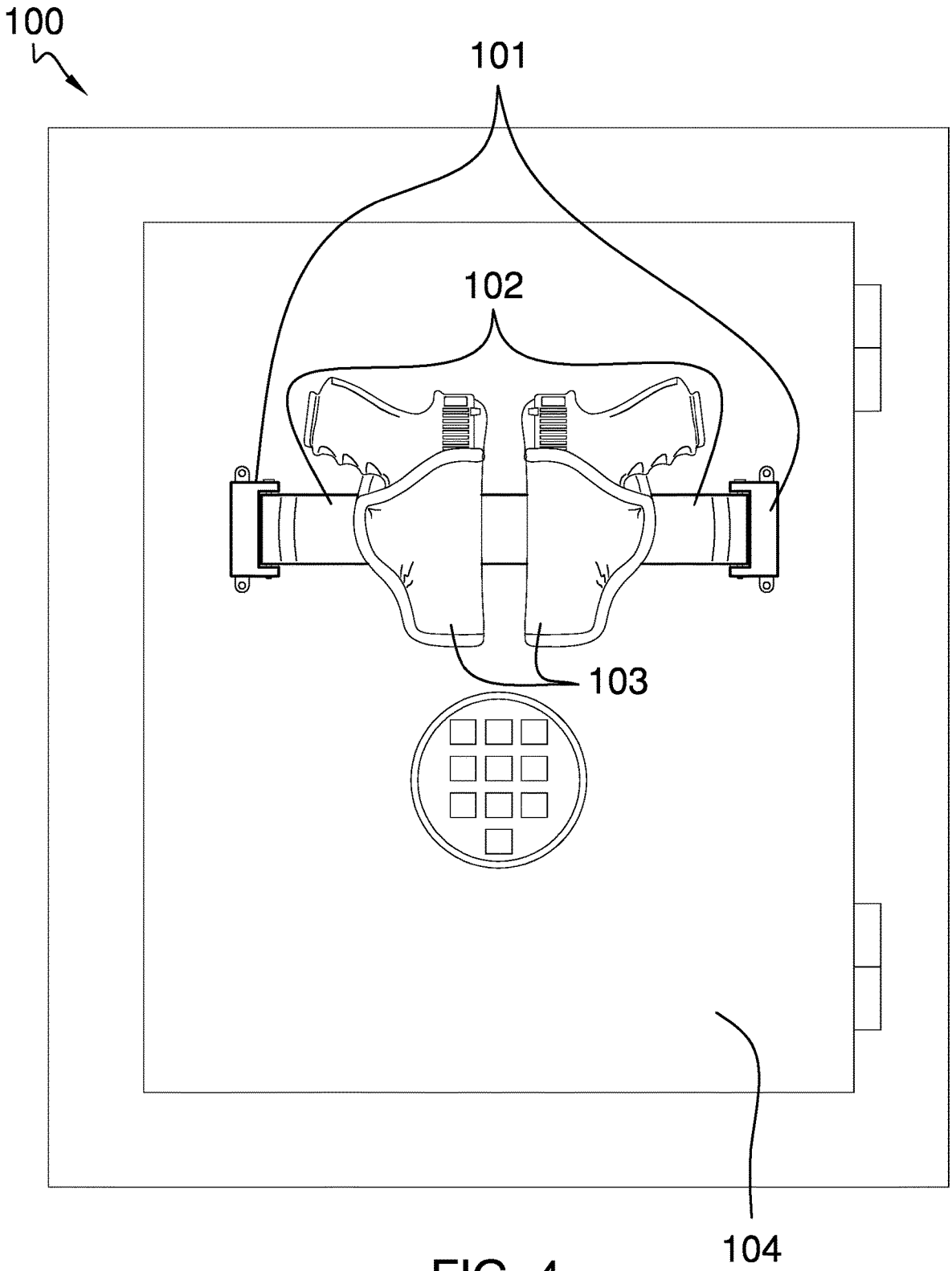
FIG. 4 is an in-use view of an embodiment of the disclosure.
Figure 6:
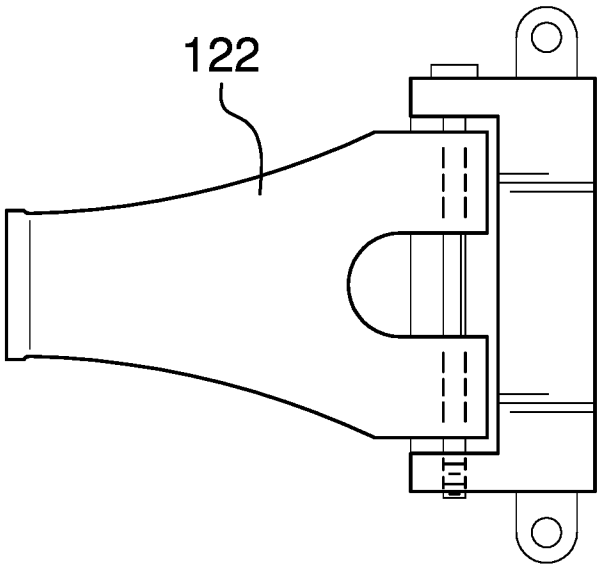
FIG. 6 is a front view of the alternate embodiment of the disclosure.
Figure 5:
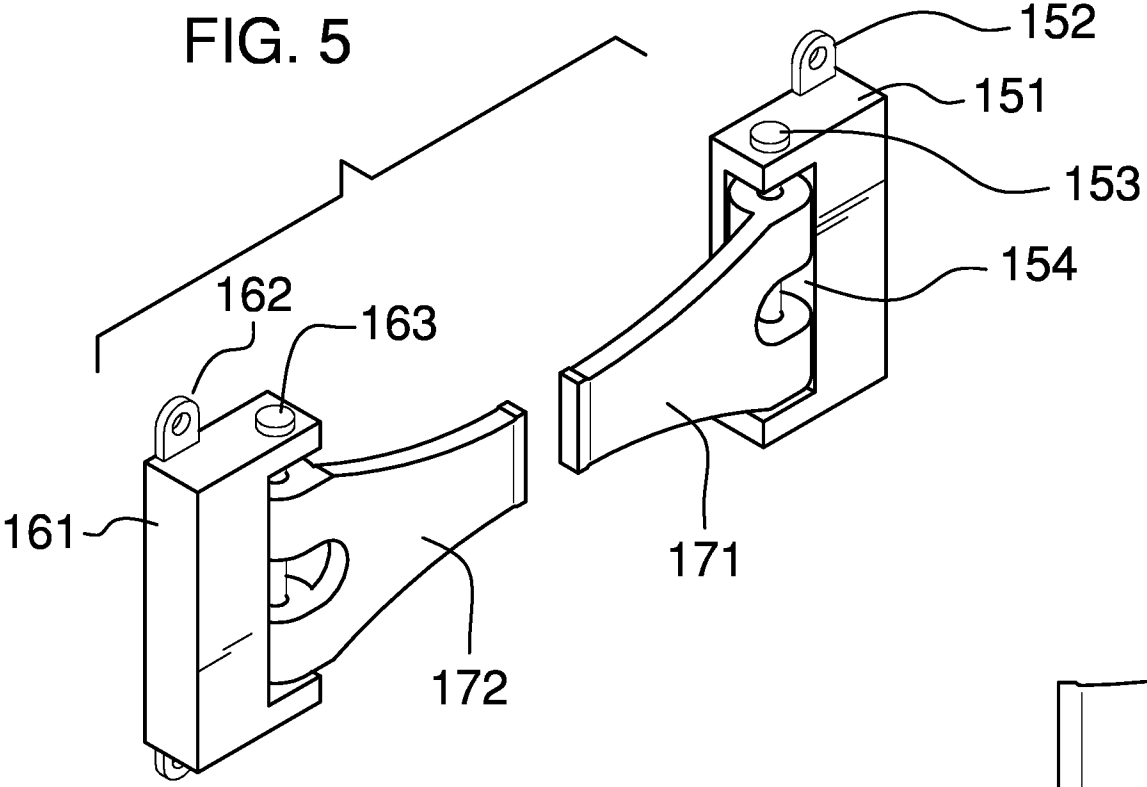
FIG. 5 is a perspective view of an alternate embodiment of the disclosure.
Figure 7:
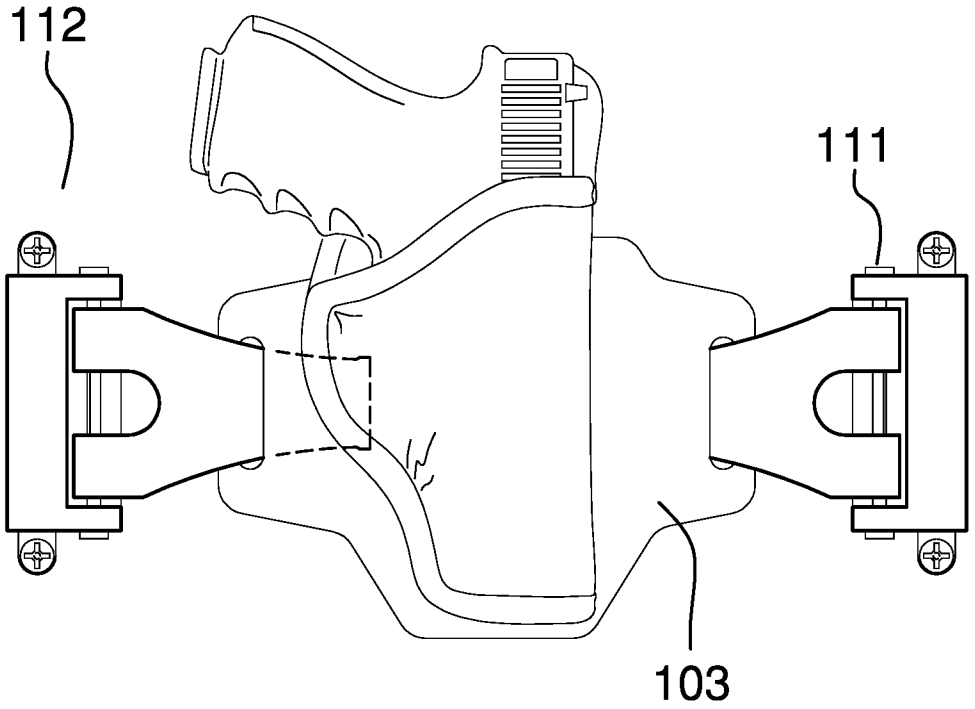
FIG. 7 is the in-use view of an embodiment of the disclosure.

Detailed reference will now be made to one or more potential embodiments of the disclosure, which are illustrated in FIGS. 1 through 7.

The holster-mounting system 100 (hereinafter invention) is a load bearing structure. The invention 100 comprises a plurality of mounting structures 101, a plurality of securing structures 102, and a holster structure 103. The invention 100 attaches the holster structure 103 to a mounting surface 104. Any securing structure selected from the plurality of securing structures 102 secures the holster structure 103 to the plurality of mounting structures 101. Any securing structure selected from the plurality of securing structures 102 transfers the load of the holster structure 103 to the plurality of mounting structures 101. The plurality of mounting structures 101 secures any securing structure selected from the plurality of securing structures 102 to the mounting surface 104.

The mounting surface 104 is a surface. The mounting surface 104 forms a load bearing structure. The mounting surface 104 is the surface that is designated to receive the load of the invention 100.

The holster structure 103 is a holster. The holster structure 103 is a storage structure. The holster structure 103 is adapted to receive a tool like structure such as a weapon. The holster structure 103 secures the tool like structure to the invention 100.

The plurality of mounting structures 101 form the load bearing structures that attach the plurality of securing structures 102 to the mounting surface 104. The plurality of mounting structures 101 magnetically attach to the mounting surface 104. The plurality of mounting structures 101 allow for the temporary attachment of the invention 100 to the mounting surface 104. The plurality of mounting structures 101 further allow for the permanent attachment of the invention 100 to the mounting surface 104. The plurality of mounting structures 101 comprises a first mounting plate 111 and a second mounting plate 112.

The first mounting plate 111 is a roughly disk shaped structure. The first mounting plate 111 has the primary shape of a disk. The first mounting plate 111 is a magnetic structure. The first mounting plate 111 magnetically attaches to the mounting surface 104. The first mounting plate 111 rests flush against the mounting surface 104. The first mounting plate 111 comprises a first mounting disk 151, a first plurality of mounting nuts 152, and a first pivot shaft 153.

The first mounting disk 151 is a roughly disk shaped structure. The first mounting disk 151 forms the primary shape of the first mounting plate 111. The first mounting disk 151 is a magnetic structure. The first mounting disk 151 magnetically attaches to the mounting surface 104. A congruent end of the disk structure of the first mounting disk 151 rests flush against the mounting surface 104. The first mounting disk 151 further comprises a first pivot notch 154. The first pivot notch 154 is a negative space that is formed in the first mounting disk 151. The first pivot notch 154 is sized such that the first pivot shaft 153 fits within the negative space of the first pivot notch 154.

Each mounting nut selected from the first plurality of mounting nuts 152 is a nut. Each mounting nut selected from the first plurality of mounting nuts 152 attaches to the lateral face of the disk structure of the first mounting disk 151. Each mounting nut selected from the first plurality of mounting nuts 152 forms a portion of a threaded connection used to permanently attach the first mounting plate 111 to the mounting surface 104. Each mounting nut selected from the first plurality of mounting nuts 152 forms the nut that allows the first mounting disk 151 to be bolted to the mounting surface 104.

The first pivot shaft 153 is a prism shaped structure. The first pivot shaft 153 is a rigid structure. The first pivot shaft 153 forms an anchor point that a securing structure selected from the plurality of securing structures 102 attaches to. The first pivot shaft 153 forms an axis of rotation that allows the selected securing structure that attaches to the first pivot shaft 153 to rotate around the first pivot shaft 153.

The second mounting plate 112 is a roughly disk shaped structure. The second mounting plate 112 has the primary shape of a disk. The second mounting plate 112 is a magnetic structure. The second mounting plate 112 magnetically attaches to the mounting surface 104. The second mounting plate 112 rests flush against the mounting surface 104. The second mounting plate 112 is identical to the first mounting plate 111. The second mounting plate 112 comprises a second mounting disk 161, a second plurality of mounting nuts 162, and a second pivot shaft 163.

The second mounting disk 161 is a roughly disk shaped structure. The second mounting disk 161 forms the primary shape of the second mounting plate 112. The second mounting disk 161 is a magnetic structure. The second mounting disk 161 magnetically attaches to the mounting surface 104. A congruent end of the disk structure of the second mounting disk 161 rests flush against the mounting surface 104. The second mounting disk 161 further comprises a second pivot notch 164. The second pivot notch 164 is a negative space that is formed in the second mounting disk 161. The second pivot notch 164 is sized such that the second pivot shaft 163 fits within the negative space of the second pivot notch 164.

Each mounting nut selected from the second plurality of mounting nuts 162 is a nut. Each mounting nut selected from the second plurality of mounting nuts 162 attaches to the lateral face of the disk structure of the second mounting disk 161. Each mounting nut selected from the second plurality of mounting nuts 162 forms a portion of a threaded connection used to permanently attach the second mounting plate 112 to the mounting surface 104. Each mounting nut selected from the second plurality of mounting nuts 162 forms the nut that allows the second mounting disk 161 to be bolted to the mounting surface 104.

The second pivot shaft 163 is a prism shaped structure. The second pivot shaft 163 is a rigid structure. The second pivot shaft 163 forms an anchor point that a securing structure selected from the plurality of securing structures 102 attaches to. The second pivot shaft 163 forms an axis of rotation that allows the selected securing structure that attaches to the second pivot shaft 163 to rotate around the second pivot shaft 163.

The plurality of securing structures 102 comprises a collection of securing structures. Each securing structure selected from the plurality of securing structures 102 is a mechanical structure. Each selected securing structure forms the physical structure that secures the holster structure 103 to the plurality of mounting structures 101. The plurality of securing structures 102 are interchangeable. By interchangeable is meant that any initially selected securing structure selected from the plurality of securing structures 102 can be replaced with a subsequently selected securing structure selected from the plurality of securing structures 102. The securing structure selected from the plurality of securing structures 102 is chosen based on the specific holster structure 103 that will attach to the invention 100. The plurality of securing structures 102 comprises a mounting webbing 121 and a plurality of latch brackets 122.

The mounting webbing 121 is a securing structure selected from the plurality of securing structures 102. The mounting webbing 121 removably attaches to the first pivot shaft 153 of the first mounting plate 111. The mounting webbing 121 removably attaches to the second pivot shaft 163 of the second mounting plate 112. The first mounting plate 111 and the second mounting plate 112 suspend the mounting webbing 121 above a supporting surface. The holster structure 103 clips onto the mounting webbing 121 such that the mounting webbing 121 suspends the holster structure 103 from the mounting surface 104. The mounting webbing 121 is a textile based structure. The mounting webbing 121 is a webbing structure.

The plurality of latch brackets 122 is a securing structure selected from the plurality of securing structures 102. An initial latch bracket selected from the plurality of latch brackets 122 removably attaches to the first pivot shaft 153 of the first mounting plate 111. A subsequent latch bracket selected from the plurality of latch brackets 122 removably attaches to the second pivot shaft 163 of the second mounting plate 112. The initially selected latch bracket attaches to the first pivot shaft 153 such that the selected latch bracket rotates relative to the first pivot shaft 153. The subsequently selected latch bracket attaches to the second pivot shaft 163 such that the selected latch bracket rotates relative to the second pivot shaft 163.

Each latch bracket selected from the plurality of latch brackets 122 forms a component of a fastening device. Each latch bracket selected from the plurality of latch brackets 122 attaches to a matching component of the fastening device that is mounted on the holster structure 103. The plurality of latch brackets 122 suspends the holster structure 103 from the mounting surface 104. The plurality of latch brackets 122 transfers the load of the holster structure 103 to the mounting surface 104 through the plurality of mounting structures 101. The plurality of latch brackets 122 comprises a first latch bracket 171 and a second latch bracket 172.

The first latch bracket 171 is a mechanical structure. The first latch bracket 171 attaches to the first pivot shaft 153 of the first mounting plate 111 such that the first latch bracket 171 rotates relative to the first pivot shaft 153. The first latch bracket 171 forms the physical structure that latches the first mounting plate 111 to the holster structure 103. The second latch bracket 172 is a mechanical structure. The second latch bracket 172 attaches to the second pivot shaft 163 of the second mounting plate 112 such that the second latch bracket 172 rotates relative to the second pivot shaft 163. The second latch bracket 172 forms the physical structure that latches the second mounting plate 112 to the holster structure 103.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Belt: As used in this disclosure, a belt is a strip of flexible material.

Bolt: As used in this disclosure, a bolt is a cylindrical shaft that is formed with an exterior screw thread. A bolt is defined with an outer dimension.

Bolt Head: As used in this disclosure, a bolt head refers to a disk shaped structure that mounts on a congruent end of the cylinder shaft that forms the bolt.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Clean Nut: As used in this disclosure, a clean nut is a negative space that is formed through the faces of a prism-shaped disk structure. The negative space that forms the clean nut forms a disk-shaped structure that allows a shaft to be inserted through the faces of the disk. The use of the term clean nut indicates that an interior screw thread is not formed on the lateral face of the clean nut. The clean nut is further defined with an inner dimension. A clean nut is also referred to as a washer and a spacer.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Conflict: As used in this disclosure, a conflict refers to a plurality of entities where any first entity selected from the plurality of entities is attempting to achieve a first objective and any second entity selected from the plurality of entities is attempting to achieve a second objective. In a conflict, the achievement of the first objective is in some way incompatible with the achievement of the second objective. Examples of entities selected from plurality of entities include, but are not limited to, individual biological entities, organizations, and societies.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Elevation: As used in this disclosure, elevation refers to the span of the distance in the superior direction between a specified horizontal surface and a reference horizontal surface. Unless the context of the disclosure suggest otherwise, the specified horizontal surface is the supporting surface the potential embodiment of the disclosure rests on. The infinitive form of elevation is to elevate.

Exterior: As used in this disclosure, the exterior is used as a relational term that implies that an object is not contained within the boundary of a structure or a space.

Exterior Screw Thread: An exterior screw thread is a ridge wrapped around the outer surface of a tube in the form of a helical structure that is used to convert rotational movement into linear movement.

Firearm: As used in this disclosure, a firearm is a handheld weapon designed to expel a projectile which has been accelerated using a mechanism comprising an explosion or an explosive decompression (referred to in this definition as explosive decompression). The combination of the projectile and the chemical compound required to generate the explosive decompression is called the ammunition. The primary components of a firearm comprise a barrel, a firing mechanism, a trigger, and a stock structure. The barrel is a tubular structure that guides the projectile out of the firearm after the explosive decompression has occurred. The firing mechanism: a) stores ammunition; b) loads the ammunition into the firing mechanism; c) initiates the explosive decompression that accelerates the projectile out of the barrel; and, d) discharges unnecessary components from the firearm after the explosive decompression. The trigger is a lever that initiates the explosive decompression within the firing mechanism. A safety refers to a mechanical mechanism that prevents the operation of the trigger. The stock forms the structure on which the barrel, firing mechanism, and the trigger mount. On larger handheld firearms (commonly called rifles), the stock further comprises a forestock and a buttstock. On smaller handheld firearms (commonly called pistols) the stock is commonly called the grip.

Force of Gravity: As used in this disclosure, the force of gravity refers to a vector that indicates the direction of the pull of gravity on an object at or near the surface of the earth.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1. By the term essentially geometrically similar is meant that the primary shapes of two objects are geometrically similar except that there are functional items (such as fastening devices) associated with the primary shape may not maintain the ratio for geometric similarity. By the term roughly geometrically similar is meant that the form factors between the primary shape of the two objects can vary by a factor of up to 10% when the two objects are normalized to be roughly geometrically identical.

Helix: As used in this disclosure, a helix is the three-dimensional structure that would be formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute.

Holster: As used in this disclosure, a holster is a storage pouch that attaches to an object such as a belt, a webbing, a sling, or a luggage item. The holster is dedicated to containing a previously identified object such that the previously identified object is readily accessible.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to a directional reference that is parallel to and in the same direction as the force of gravity when an object is positioned or used normally.

Interchangeable: As used in this disclosure, interchangeable refers to the ability to remove and replace an element of a structure. For example, if a first object that is attached to a structure can be removed and replaced with a second object selected from a plurality of compatible objects than the first object is said to be replaceable with both: 1) the second object; and, 2) each of the elements of compatible objects. The term interchangeable is commonly associated with tools. Interchangeable objects are often used to change the function or the performance characteristics of a tool.

Interior: As used in this disclosure, the interior is used as a relational term that implies that an object is contained within the boundary of a structure or a space.

Interior Screw Thread: An interior screw thread is a groove that is formed around the inner surface of a tube in the form of a helical structure that is used to convert rotational movement into linear movement.

Latch: As used in this disclosure, a latch is a fastening or locking mechanism. The use of the term latch does not necessarily but often implies the insertion of an object into a notch or cavity.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Magnet: As used in this disclosure, a magnet is an ore, alloy, or other material that has its component atoms arranged so the material exhibits properties of magnetism such as: 1) attracting other iron-containing objects; 2) attracting other magnets; or, 3) or aligning itself in an external magnetic field. A magnet is further defined with a north pole and a south pole. By aligning with an external magnetic field is meant that the north-south pole structure of a first magnet will align with the north south pole of a second magnet. The pole of any first magnet will attract the opposite pole of any second magnet (i.e. a north pole will attract a south pole).

Magnetic Material: As used in this disclosure, a magnetic material is a substance that attracts or is attracted to a magnet but that itself has no net magnetic moment (beyond any residual moment created by prior use). Common classes of magnetic materials include ferromagnetic, diamagnetic, paramagnetic, ferrimagnetic and antiferromagnetic.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

Nut: As used in this disclosure, a nut is a first object that is formed with a cylindrical negative space that further comprises an interior screw thread such that a second object with a matching exterior screw thread can screwed into the first object forming a threaded connection. A nut is further defined with an inner dimension.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan are open.

Pedestal: As used in this disclosure, a pedestal is an intermediary load bearing structure that forms a load path between two objects or structures.

Perimeter: As used in this disclosure, a perimeter is one or more curved or straight lines that bounds an enclosed area on a plane or surface. The perimeter of a circle is commonly referred to as a circumference.

Pivot: As used in this disclosure, a pivot is a rod or shaft around which an object rotates or swings.

Primary Shape: As used in this disclosure, the primary shape refers to a description of the rough overall geometric shape of an object that is assembled from multiple components or surfaces.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rotation: As used in this disclosure, rotation refers to the cyclic movement of an object around a fixed point or fixed axis. The verb of rotation is to rotate.

Roughly: As used in this disclosure, roughly refers to a comparison between two objects. Roughly means that the difference between one or more parameters of the two compared objects are not significantly different.

Screw: As used in this disclosure, to screw is a verb meaning: 1) to fasten or unfasten (unscrew) a threaded connection; or 2) to attach a helical structure to a solid structure.

Sheeting: As used in this disclosure, a sheeting is a material, such as a paper, textile, a plastic, or a metal foil, in the form of a thin flexible layer or layers. The sheeting forms a disk structure. The two surfaces of the sheeting with the greatest surface area are called the faces of the sheeting.

Surface: As used in this disclosure, a surface refers to a structure selected from the group consisting of: a) a solid boundary structure that is exposed to (or adjacent to) a negative space; and, b) a boundary structure that forms the separation between two compounds (or objects) of different phases.

Suspend: As used in this disclosure, to suspend an object means to support an object such that the inferior end of the object does not form a significant portion of the load path of the object.

Textile: As used in this disclosure, a textile is a material that is woven, knitted, braided, or felted. Synonyms in common usage for this definition include fabric and cloth. The two surfaces of the textile with the greatest surface area are called the faces of the textile.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Weapon: As used in this disclosure, a weapon is a tool that is used to gain an advantage in a conflict. The term weapon is often assumed to be a tool that is used to injure or kill a biological entity.

Webbing: As used in this disclosure, a webbing is strong, close woven or knitted fabric that is used for straps or belting. As used in this disclosure, webbing is a fully formed material that is only cut to length for use. Webbing is not formed by cutting broader materials into strips. Webbings have tensile strength but are too flexible to provide compressive strength and are not suitable for use in pushing objects. The shape of a webbing is approximated by a rectangular disk shape. The two surfaces of a webbing with the greatest surface area are called the faces of the webbing.

Superior: As used in this disclosure, the term superior refers to a directional reference that is parallel to and in the opposite direction of the force of gravity when an object is positioned or used normally.

Supporting Surface: As used in this disclosure, a supporting surface is a horizontal surface upon which an object is placed and to which the load of the object is transferred. This disclosure assumes that an object placed on the supporting surface is in an orientation that is appropriate for the normal or anticipated use of the object.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A holster-mounting system comprising wherein the holster-mounting system comprises a plurality of mounting structures, a plurality of securing structures, and a holster structure;

wherein the plurality of mounting structures secures any securing structure selected from the plurality of securing structures to a mounting surface;

wherein any securing structure selected from the plurality of securing structures secures the holster structure to the plurality of mounting structures;

wherein the holster structure is adapted to receive and secure a tool to the holster-mounting system;

wherein the plurality of mounting structures comprises a first mounting plate and a second mounting plate;

wherein the first mounting plate comprises a first mounting disk, a first plurality of mounting nuts, and a first pivot shaft;

wherein the first mounting disk magnetically attaches to the mounting surface;

wherein the first pivot shaft forms an anchor point that a securing structure selected from the plurality of securing structures attaches to;

wherein the first pivot shaft forms an axis of rotation that allows the selected securing structure that attaches to the first pivot shaft to rotate around the first pivot shaft.

2. The holster-mounting system according to claim 1 wherein the holster-mounting system is a load bearing structure;

wherein the holster-mounting system attaches the holster structure to the mounting surface;

wherein any securing structure selected from the plurality of securing structures transfers the load of the holster structure to the plurality of mounting structures.

3. The holster-mounting system according to claim 2 wherein the mounting surface is a surface;

wherein the mounting surface forms a load bearing structure;

wherein the holster structure is a holster;

wherein the holster structure is a storage structure.

4. The holster-mounting system according to claim 3 wherein the plurality of mounting structures form the load bearing structures that attach the plurality of securing structures to the mounting surface;

wherein the plurality of mounting structures magnetically attach to the mounting surface;

wherein the plurality of mounting structures allow for the temporary attachment of the holster-mounting system to the mounting surface;

wherein the plurality of mounting structures further allow for the permanent attachment of the holster-mounting system to the mounting surface.

5. The holster-mounting system according to claim 4 wherein the plurality of securing structures comprises a collection of securing structures;

wherein each securing structure selected from the plurality of securing structures is a mechanical structure;

wherein each selected securing structure forms the physical structure that secures the holster structure to the plurality of mounting structures;

wherein the plurality of securing structures are interchangeable;

wherein by interchangeable is meant that any initially selected securing structure selected from the plurality of securing structures can be replaced with a subsequently selected securing structure selected from the plurality of securing structures;

wherein the securing structure selected from the plurality of securing structures is chosen based on the specific holster structure that will attach to the holster-mounting system.

6. The holster-mounting system according to claim 5 wherein the first mounting plate is a roughly disk shaped structure;

wherein the first mounting plate has the primary shape of a disk;

wherein the first mounting plate is a magnetic structure;

wherein the first mounting plate magnetically attaches to the mounting surface;

wherein the first mounting plate rests flush against the mounting surface;

wherein the second mounting plate is a roughly disk shaped structure;

wherein the second mounting plate has the primary shape of a disk;

wherein the second mounting plate is a magnetic structure;

wherein the second mounting plate magnetically attaches to the mounting surface;

wherein the second mounting plate rests flush against the mounting surface;

wherein the second mounting plate is identical to the first mounting plate.

7. The holster-mounting system according to claim 6 wherein the first mounting disk is a roughly disk shaped structure;

wherein the first mounting disk forms the primary shape of the first mounting plate;

wherein the first mounting disk is a magnetic structure;

wherein a congruent end of the disk structure of the first mounting disk rests flush against the mounting surface;

wherein the first mounting disk further comprises a first pivot notch;

wherein the first pivot notch is a negative space that is formed in the first mounting disk;

wherein the first pivot notch is sized such that the first pivot shaft fits within the negative space of the first pivot notch;

wherein each mounting nut selected from the first plurality of mounting nuts is a nut;

wherein each mounting nut selected from the first plurality of mounting nuts attaches to the lateral face of the disk structure of the first mounting disk;

wherein each mounting nut selected from the first plurality of mounting nuts forms a portion of a threaded connection used to permanently attach the first mounting plate to the mounting surface;

wherein each mounting nut selected from the first plurality of mounting nuts forms the nut that allows the first mounting disk to be bolted to the mounting surface;

wherein the first pivot shaft is a prism shaped structure;

wherein the first pivot shaft is a rigid structure.

8. The holster-mounting system according to claim 7 wherein the second mounting plate comprises a second mounting disk, a second plurality of mounting nuts, and a second pivot shaft;

wherein the second mounting disk is a roughly disk shaped structure;

wherein the second mounting disk forms the primary shape of the second mounting plate;

wherein the second mounting disk is a magnetic structure;

wherein the second mounting disk magnetically attaches to the mounting surface;

wherein a congruent end of the disk structure of the second mounting disk rests flush against the mounting surface;

wherein the second mounting disk further comprises a second pivot notch;

wherein the second pivot notch is a negative space that is formed in the second mounting disk;

wherein the second pivot notch is sized such that the second pivot shaft fits within the negative space of the second pivot notch;

wherein each mounting nut selected from the second plurality of mounting nuts is a nut;

wherein each mounting nut selected from the second plurality of mounting nuts attaches to the lateral face of the disk structure of the second mounting disk;

wherein each mounting nut selected from the second plurality of mounting nuts forms a portion of a threaded connection used to permanently attach the second mounting plate to the mounting surface;

wherein each mounting nut selected from the second plurality of mounting nuts forms the nut that allows the second mounting disk to be bolted to the mounting surface;

wherein the second pivot shaft is a prism shaped structure;

wherein the second pivot shaft is a rigid structure;

wherein the second pivot shaft forms an anchor point that a securing structure selected from the plurality of securing structures attaches to;

wherein the second pivot shaft forms an axis of rotation that allows the selected securing structure that attaches to the second pivot shaft to rotate around the second pivot shaft.

9. The holster-mounting system according to claim 8 wherein the plurality of securing structures comprises a mounting webbing;

wherein the mounting webbing is a securing structure selected from the plurality of securing structures;

wherein the mounting webbing removably attaches to the first pivot shaft of the first mounting plate;

wherein the mounting webbing removably attaches to the second pivot shaft of the second mounting plate;

wherein the first mounting plate and the second mounting plate suspend the mounting webbing above a supporting surface;

wherein the holster structure clips onto the mounting webbing such that the mounting webbing suspends the holster structure from the mounting surface;

wherein the mounting webbing is a textile based structure;

wherein the mounting webbing is a webbing structure.

10. The holster-mounting system according to claim 8 wherein the plurality of securing structures comprises a plurality of latch brackets;

wherein the plurality of latch brackets is a securing structure selected from the plurality of securing structures;

wherein an initial latch bracket selected from the plurality of latch brackets removably attaches to the first pivot shaft of the first mounting plate;

wherein a subsequent latch bracket selected from the plurality of latch brackets removably attaches to the second pivot shaft of the second mounting plate;

wherein the initially selected latch bracket attaches to the first pivot shaft such that the selected latch bracket rotates relative to the first pivot shaft;

wherein the subsequently selected latch bracket attaches to the second pivot shaft such that the selected latch bracket rotates relative to the second pivot shaft;

wherein each latch bracket selected from the plurality of latch brackets forms a component of a fastening device;

wherein each latch bracket selected from the plurality of latch brackets attaches to a matching component of the fastening device that is mounted on the holster structure;

wherein the plurality of latch brackets suspends the holster structure from the mounting surface;

wherein the plurality of latch brackets transfers the load of the holster structure to the mounting surface through the plurality of mounting structures;

wherein the plurality of latch brackets comprises a first latch bracket and a second latch bracket;

wherein the first latch bracket is a mechanical structure;

wherein the first latch bracket attaches to the first pivot shaft of the first mounting plate such that the first latch bracket rotates relative to the first pivot shaft;

wherein the first latch bracket forms the physical structure that latches the first mounting plate to the holster structure;

wherein the second latch bracket is a mechanical structure;

wherein the second latch bracket attaches to the second pivot shaft of the second mounting plate such that the second latch bracket rotates relative to the second pivot shaft;

wherein the second latch bracket forms the physical structure that latches the second mounting plate to the holster structure.

11. The holster-mounting system according to claim 8 wherein the plurality of securing structures comprises a mounting webbing and a plurality of latch brackets;

wherein the mounting webbing is a securing structure selected from the plurality of securing structures;

wherein the mounting webbing removably attaches to the first pivot shaft of the first mounting plate;

wherein the mounting webbing removably attaches to the second pivot shaft of the second mounting plate;

wherein the first mounting plate and the second mounting plate suspend the mounting webbing above a supporting surface;

wherein the holster structure clips onto the mounting webbing such that the mounting webbing suspends the holster structure from the mounting surface;

wherein the mounting webbing is a textile based structure;

wherein the mounting webbing is a webbing structure;

wherein the plurality of latch brackets is a securing structure selected from the plurality of securing structures;

wherein an initial latch bracket selected from the plurality of latch brackets removably attaches to the first pivot shaft of the first mounting plate;

wherein a subsequent latch bracket selected from the plurality of latch brackets removably attaches to the second pivot shaft of the second mounting plate;

wherein the initially selected latch bracket attaches to the first pivot shaft such that the selected latch bracket rotates relative to the first pivot shaft;

wherein the subsequently selected latch bracket attaches to the second pivot shaft such that the selected latch bracket rotates relative to the second pivot shaft;

wherein each latch bracket selected from the plurality of latch brackets forms a component of a fastening device;

wherein each latch bracket selected from the plurality of latch brackets attaches to a matching component of the fastening device that is mounted on the holster structure;

wherein the plurality of latch brackets suspends the holster structure from the mounting surface;

wherein the plurality of latch brackets transfers the load of the holster structure to the mounting surface through the plurality of mounting structures;

wherein the plurality of latch brackets comprises a first latch bracket and a second latch bracket;

wherein the first latch bracket is a mechanical structure;

wherein the first latch bracket attaches to the first pivot shaft of the first mounting plate such that the first latch bracket rotates relative to the first pivot shaft;

wherein the first latch bracket forms the physical structure that latches the first mounting plate to the holster structure;

wherein the second latch bracket is a mechanical structure;

wherein the second latch bracket attaches to the second pivot shaft of the second mounting plate such that the second latch bracket rotates relative to the second pivot shaft;

wherein the second latch bracket forms the physical structure that latches the second mounting plate to the holster structure.

* * * * *